US005163030A

United States Patent [19]

Gagnebin et al.

[11] Patent Number: 5,163,030

[45] Date of Patent: Nov. 10, 1992

[54] WATCH CASE INTENDED FOR AUTOMATED ASSEMBLY

[75] Inventors: Gaston Gagnebin, Bienne; Hans Maurer, Lengnau; Jacques Müller, Reconvilier, all of Switzerland

[73] Assignee: Tissot S.A., Le Locle, Switzerland

[21] Appl. No.: 619,438

[22] Filed: Nov. 29, 1990

[30] Foreign Application Priority Data

Nov. 30, 1989 [CH] Switzerland ..... 4286/89

[51] Int. Cl.[5] ..... G04B 37/00; G04B 29/00

[52] U.S. Cl. ..... 368/299; 368/300

[58] Field of Search ..... 368/88, 276, 287–296, 368/299–300

[56] References Cited

U.S. PATENT DOCUMENTS

| | | | |
|---|---|---|---|
| 3,643,424 | 2/1972 | Simon | 58/90 R |
| 4,184,317 | 1/1980 | Kanpa et al. | 368/299 |
| 4,218,873 | 8/1980 | Lang | 368/281 |
| 4,493,562 | 1/1985 | Gagnebin | 368/294 |
| 4,497,584 | 2/1985 | Ratajski | 368/294 |
| 4,522,508 | 6/1985 | Meister | 368/276 |
| 4,545,688 | 10/1985 | Ray et al. | 368/291 |
| 4,626,108 | 12/1986 | Ganter | 368/291 |

FOREIGN PATENT DOCUMENTS

| | | |
|---|---|---|
| 8020984 | 12/1980 | Fed. Rep. of Germany . |
| 898248 | 4/1945 | France . |
| 1043130 | 11/1953 | France . |
| 319293 | 3/1957 | Switzerland . |
| 1295347 | 11/1972 | United Kingdom . |

*Primary Examiner*—Vit W. Miska

*Attorney, Agent, or Firm*—Griffin, Butler, Whisenhunt & Kurtossy

[57] ABSTRACT

This watch case includes a caseband (1) and a fitting frame (2) inserted into said caseband. The frame includes a first seat (14) in which a bezel (4) rests, said bezel compressing the elastic material (15) forming the frame against the caseband, a second seat (16) in which a dial (7) is inserted, a third seat (18) in which a bead (19) provided on the movement rests, and a fourth seat (20) in which a flange (21) exhibited by the back cover (3) is inserted, such flange compressing the material forming the frame against the caseband. The watch case is sealed and lends itself particularly well to assembly on automated machinery.

5 Claims, 2 Drawing Sheets

WATCH CASE INTENDED FOR AUTOMATED ASSEMBLY

This invention concerns a watch case intended for automated assembly including a caseband, a fitting frame inserted into said caseband, said frame being formed of solid elastically deformable material, a back cover, a bezel and a crystal secured in a sealed manner to the bezel in order to define an interior space in which a movement is confined, and a dial over which time indicating hands are moved.

BACKGROUND OF THE INVENTION

A fitting frame formed of solid elastically deformable material and serving not only as a frame for adapting the movement to the case, but further for sealing said case, has been proposed for instance in patent CH-A-319 293 and in the utility model application JP-U-22693/76.

These documents however provide only a very partial solution to the problem which the present invention proposes to solve. In particular, the fitting frame shown in these documents is used only to assure sealing of the back cover or of the crystal, but not both simultaneously. Likewise, the fitting frame described in these same documents does not have as purpose, as is the case in this invention, to assure at one and the same time all the encasing functions, namely the sealed securing of a bezel and a back cover at the same time as the securing and positioning of the movement and the dial in the interior of the case, this construction enabling furthermore an automated assembly of the entire watch.

SUMMARY OF THE INVENTION

To effect such, the watch case according to the invention is characterized by the fact that the caseband includes an inner face exhibiting first and second vertical walls connected by a shoulder, said shoulder defining in the inner face of the caseband an undercut extending up to the top of the caseband and in that the fitting frame extends over the entire height of the caseband and exhibits an outer face shaped to match the form of the inner face of the caseband in a manner such that the frame may be inserted and positioned in the caseband through support of a ledge exhibited by the frame on the shoulder of the caseband, said frame including a first seat in which the bezel is inserted, said bezel compressing the material forming the frame against the caseband, a second seat in which the dial is inserted, said dial being maintained in such second seat by an overhang on the bezel, a third seat on which a bead provided on the movement rests, and a fourth seat in which a flange exhibited by the back cover is inserted, said flange compressing the material forming the frame against the caseband.

The invention will now be understood from reading the following description, such being given by way of example and illustrated by the drawings.

DESCRIPTION OF THE PREFERRED EMBODIMENTS

Figure 1:
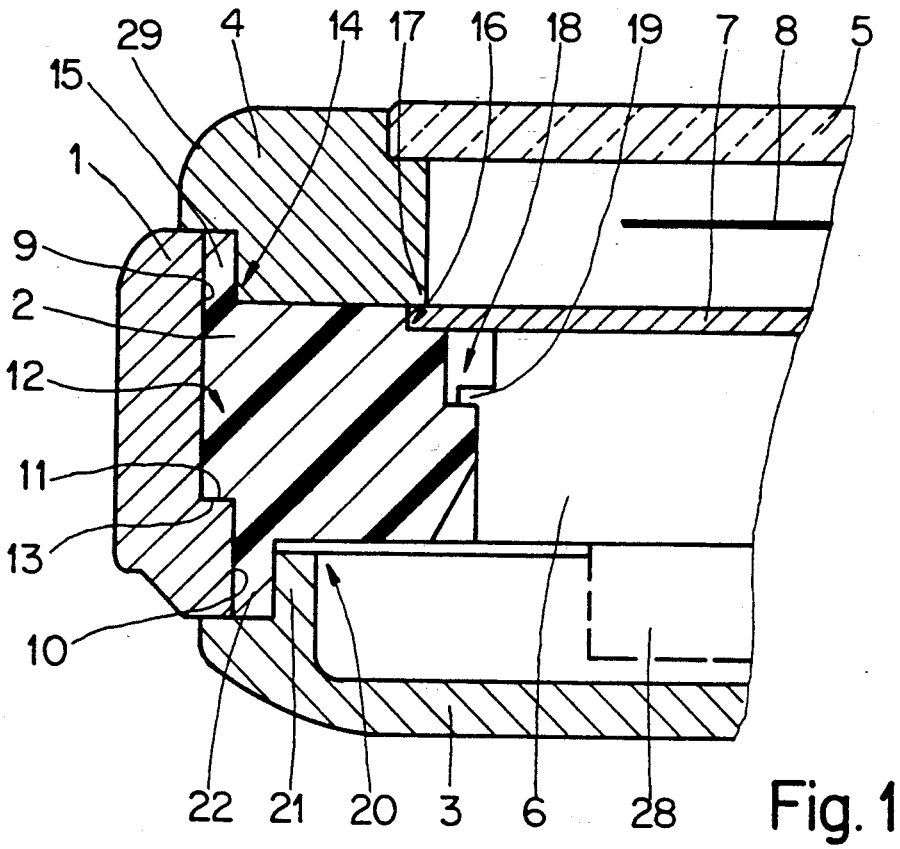
FIG. 1 is a cross-section at 9 o'clock through the watch case according to a first embodiment of the invention.
Figure 2:
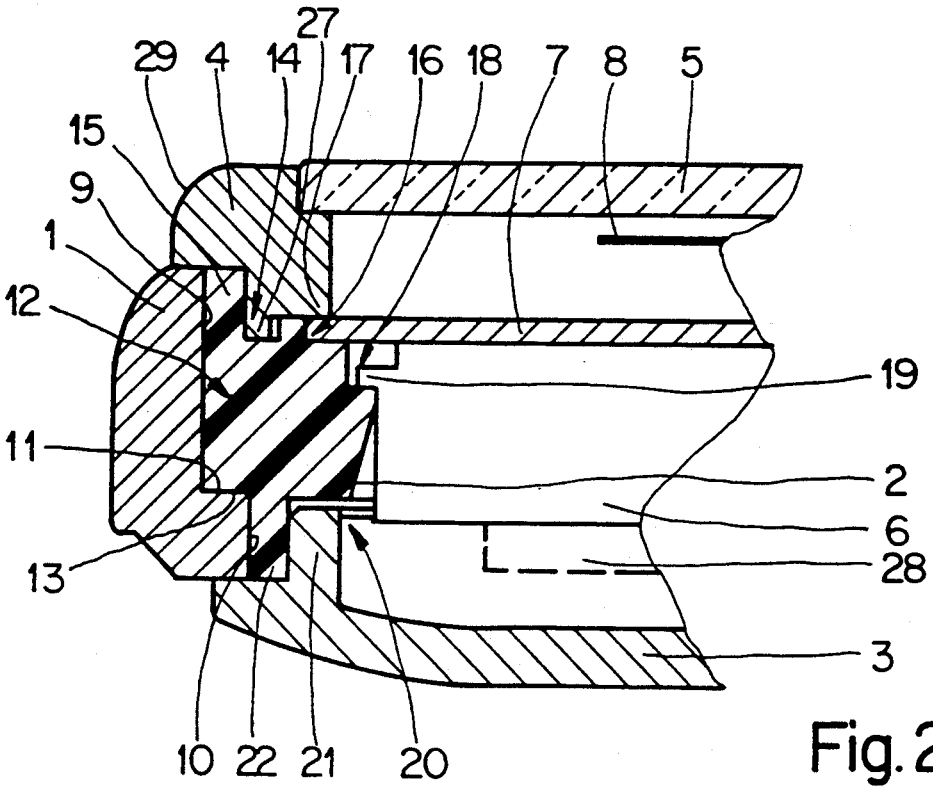
FIG. 2 shows a cross-section at 9 o'clock according to a second embodiment of the invention.
Figure 3:
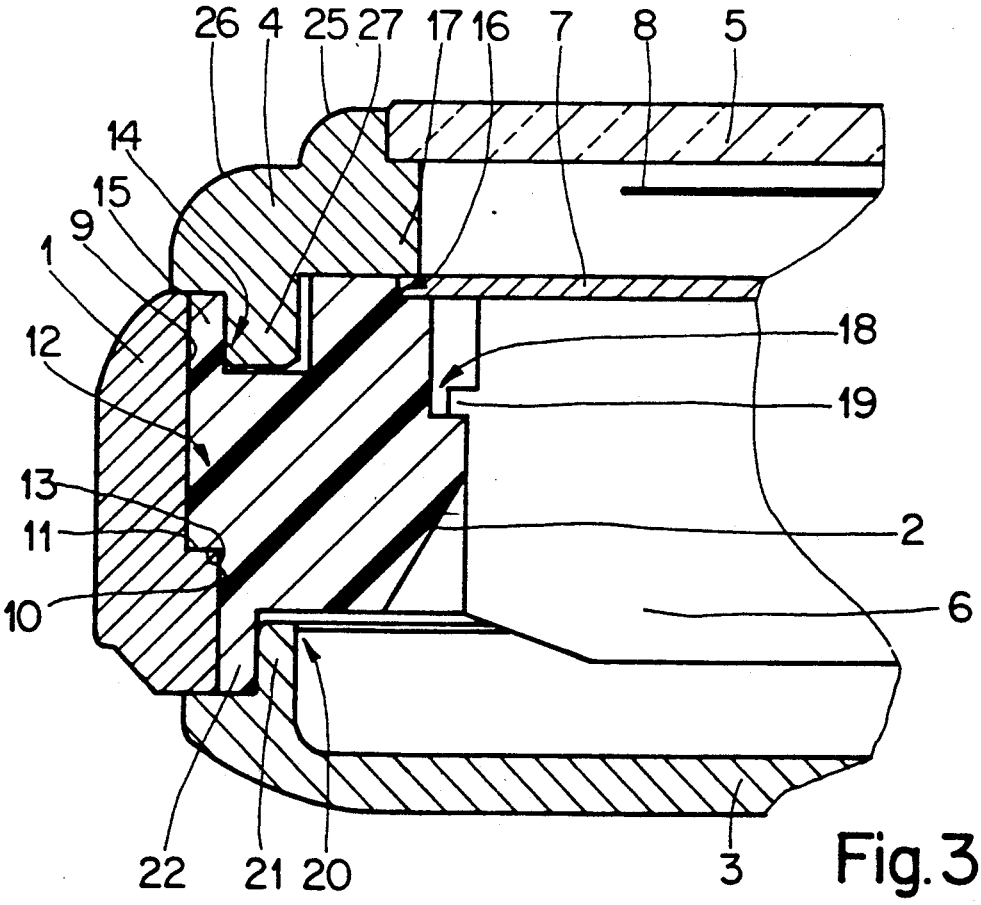
FIG. 3 shows a cross-section at 9 o'clock according to a third embodiment of the invention.

The watch case shown in cross-section on figures 1, 2 and 3 exhibits a. caseband 1, a fitting frame 2 inserted in the caseband, a back cover 3, a bezel 4 and a crystal 5. These elements define an interior closed space which contains a movement 6 surmounted by a dial 7 and hands 8. The caseband 1 may be round or otherwise shaped. In the first instance, the frame 2 will be round with a central opening which is likewise round. In the second instance, the frame 2 will be shaped and its central opening will be preferably round in order to accommodate movement 6 which itself is generally of round form.

The caseband 1 may be of metal, steel or zamac for instance, or of hard plastic material In order to form the fitting frame 2, there will be chosen a solid plastic material in order to assure good retention of the movement 6, such material being at the same time sufficiently elastic to fulfil the sealing functions which will appear hereinafter. Bezel 4 includes a seat which is annular or shaped in which there is inserted and glued crystal 5, itself round or respectively assuming a special shape.

Caseband 1 includes an inner face exhibiting a first vertical wall 9 and a second vertical wall 10. Such first and second walls are connected by a shoulder 11 which defines an undercut 12 in the inner face of the caseband extending from the shoulder 11 up to the top of the caseband 1.

As to the fitting frame 2, this extends over the entire height of the caseband 1 and the figures show that it exhibits an outer face shaped to match the form of the inner face of the caseband in a manner such that the frame 2 may be precision inserted and axially positioned relative to the caseband. In order to effect this, frame 2 includes a ledge 13 which is supported on shoulder 11 of the caseband when the frame is in place.

The internal portion of the fitting frame 2 includes four seats fulfilling precise functions which are now to be described.

Frame 2 exhibits a first seat 14 in which the bezel 4 is inserted. This seat 14, in addition to assuring centering of the bezel relative to the caseband, assures sealing of the case, as far as the portion bezel-caseband is concerned, by compression against the caseband of the material referenced 15 from which the frame 2 is formed. Frame 2 next exhibits a second seat 16 on which the dial 7 rests. The figures show that such dial is maintained in place by an overhang 17 provided on the bezel 4. Such dial, which is not attached to the movement 6 by means of feet for instance, may be angularly positioned by a stud which is fixed to the frame and inserted into a notch cut out in the dial. Frame 2 further includes a third seat 18 on which rests a bead 19 forming part of the movement 6. Thanks to this arrangement, the movement is axially held in place since on the one hand its bead is supported on seat 18 and on the other hand its upper face is retained by dial 7, itself held by the overhang 17 of bezel 4. Finally, frame 2 exhibits a fourth seat 20 in which is inserted a flange 21 forming part of the back cover 3. When the back cover 3 is applied, the flange 21 will compress the portion of material 22 forming the frame 2 against caseband 2, thus assuring sealing of the case by its portion back cover-caseband.

The explanations which have just been given are generally applicable to the various embodiments shown by figures 1, 2 and 3. Such figures differ from one another initially by the type of movement 6 employed (calibre), then by various details which are now to be reviewed.

FIG. 1 shows a construction employing an electronic movement 6, the height of which is 3 mm, this giving for the total height of the watch a value of 8.8 mm taking into account the space taken up by battery 28. In this model the lower part of the bezel 4 is rectilinear as is also rectilinear the horizontal portion of the seat 14 on which the bezel rests. The visible portion of bezel 4 shows a simple rounding off 29.

FIG. 2 shows a construction employing an electronic movement, the height of which is 2.50 mm which gives, taking into consideration the battery 28 which is here utilized, a total height of the watch of 7.20 mm. In this model, the lower part of bezel 4 shows a projection 27 introduced into seat 14 of frame 2, the lower part of this seat 14 being located at the same level as the lower part of seat 16 which accommodates dial 7. If the projection were not present, the portion of material 15 would not be sufficiently high to assure good sealing. FIG. 2 shows the same rounding off 29 as on FIG. 1.

FIG. 3 shows a construction employing a mechanical movement with automatic winding, the height of which is of 5.05 mm, which gives an overall height of the watch of 9.95 mm. As in FIG. 2 and in order to economize room in overall height, here one finds again the bottom of bezel 4 provided with a projection 27. It will here be noted that the visible part of the bezel is decorated by two rounded off portions 25 and 26 exhibiting different radii.

The invention is not limited to the movements shown by way of example on FIGS. 1, 2 and 3. Other movements, which differ in height and diameter, may also be employed.

Figure 1A:
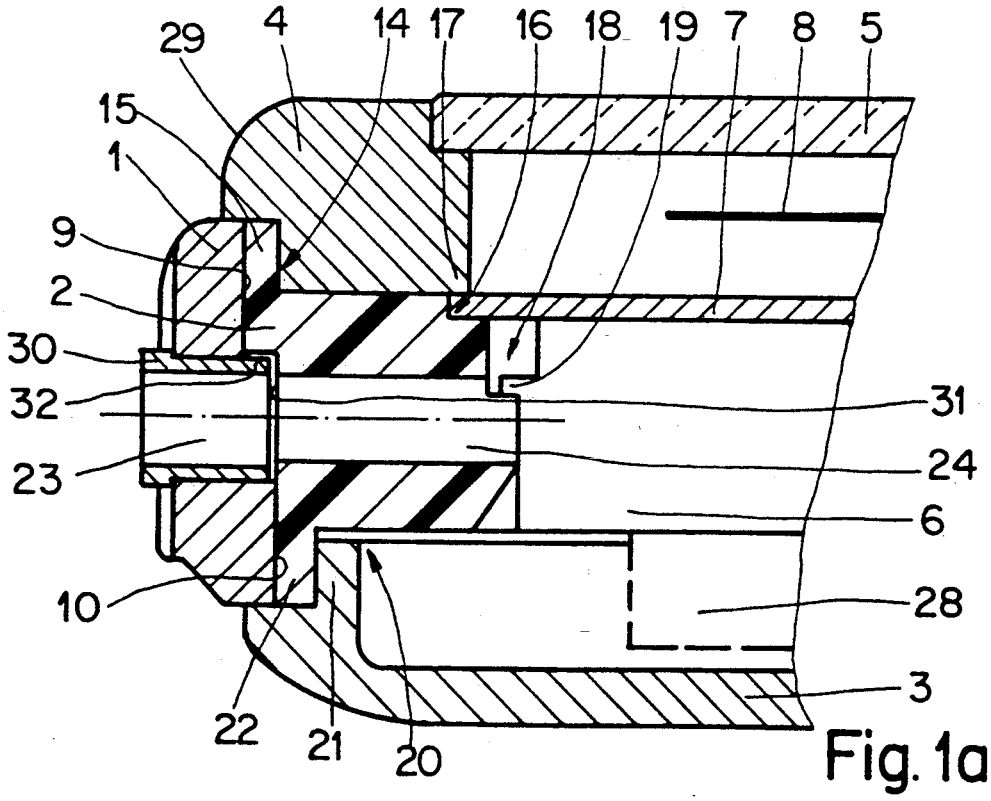
FIG. 1*a* is a cross-section at 3 o'clock through the watch case shown on FIG. 1.

FIG. 1*a* is a cross-section at 3 o'clock of the watch case shown on FIG. 1 in cross-section at 9 o'clock FIG. 1*a* shows that passages 23 and 24 are provided respectively in the caseband 1 and the frame 2. Passage 23 provided in the caseband is arranged to accommodate a tube 30 driven into this passage. It is seen that the tube 30 projects from the caseband by its end 32 directed towards the interior of the case. This end 32 is inserted into a receptacle 31 provided in the frame 2. It will be understood that this arrangement enables a proper orientation of the frame relative to the caseband in a manner such that passages 23 and 24 will be aligned when the frame is assembled into the caseband. Tube 30 and passage 24 receive in a known manner a control stem (not shown). It will be understood that orientation means for the movement relative to the frame will likewise be employed in order that the entry of the stem into the movement is located facing passage 24 provided in the frame. Such means could consist in a stud projecting from the movement, such stud cooperating with a seat provided in the frame.

The assembly of the watch for which the case forms the object of this invention, is brought about by the succession of the following steps: one provides a caseband 1 in which there has just been inserted a fitting frame 2, one introduces a movement 6 into the frame, then a dial 7 on the movement. A bezel 4 is forced in and then the hands 8 are placed. A crystal 5 is glued to the bezel. It will be noted that all the described operations up to here are effected from above, which considerably simplifies the assembly of the watch on automatic machinery. The last operation consists in closing the watch by a back cover 3 which is generally effected following turning over of the case.

Thus, for the three embodiments shown, the encasing is always effected in the same manner since the characteristics of the invention are again shown in a common manner of handling the caseband and the frame 2, and a common manner of assembling the bezel 4, dial 7, movement 6 and back cover 3 on the frame. From this fact, several lines of products may be successively assembled by the same apparatus by means of minor modifications which require only little time in order to pass from one product line to the other. It will also be understood that, since the dial and the hands are not connected to the movement, one may rapidly change the type of dial and hands without stopping the production line. The same remark may be made in respect of the bezel which may exhibit various forms or decorations on its visible portion.

What we claim is:

1. A watch case intended for automated assembly including a caseband, a fitting frame inserted in the caseband, said fitting frame being formed form solid, elastically deformable material, a back cover, a bezel and a crystal secured in a sealed manner to the bezel so as to define an interior space within which a movement is confined and a dial over which time indicating hands are displaced, wherein the caseband includes an inner face exhibiting first and second vertical walls connected by a shoulder and together defining the entire height of said inner face, said shoulder defining an undercut on the inner face of said caseband extending up to the top of caseband, and wherein the fitting frame extends over the entire height of the caseband and exhibits an outer face shaped to match the form of the inner face of the caseband in a manner such that the frame may be inserted and positioned in the caseband through support of a ledge exhibited by the frame on the shoulder of the caseband, said frame including a first seat on which the bezel rests, said bezel compressing the material forming the frame against the caseband, a second seat on which the dial rests, said dial being retained in such second seat by an overhang on the bezel, a third seat on which a bead provided on the movement rests and a fourth seat in which a flange exhibited by the back cover is inserted, said flange compressing the material forming the frame against the caseband.

2. A watch case as set forth in claim 1 wherein passages are provided respectively in the caseband and the frame, the passage provided in the caseband being arranged to receive a tube, the end of the said tube directed toward the interior of the case being inserted into a receptacle provided in the frame.

3. A watch case including a caseband, a fitting frame of solid elastically deformable material adjacent said caseband, a back cover and a crystal secured in a sealed manner to the bezel so as to define an interior space within which a movement is confined and a dial over which time indicating hands are displaced, characterized in that:

said caseband has an inner face defined by upper and lower vertical wall joined by a shoulder such that said lower wall is offset toward said interior space relative to said upper wall;

said fitting frame has an outer face shaped to match the form of the inner face of the caseband and a stepped inner face comprising, from top to bottom, a first vertical wall extending downwardly to a first seating surface, a second vertical wall extending downwardly from said first seating surface to a second seating surface and a third vertical wall extending downwardly from said second seating surface to a third seating surface, said first vertical wall being farther from said interior space than said second vertical wall and said second vertical wall being farther from said interior space than said third vertical wall;

said movement has a bead which rests on said third seating surface, said dial rests on said second seating surface; and, said bezel rests on said first seating surface and presses outwardly against said first vertical wall to compress the fitting frame against the caseband.

4. A watch case as claimed in claim 3 wherein said inner face of said fitting frame has a fourth vertical wall extending upwardly from the bottom of the fitting frame to a fourth seating surface, said back cover having a flange which presses against said fourth vertical wall to compress said fitting frame against said caseband.

5. A watch case as claimed in claim 1 wherein passages are provided in the caseband and the fitting frame, respectively, the passage in the caseband having a tube therein, an end of said tube extending toward said interior space being inserted into a receptacle provided in said fitting frame.

* * * * *